US005943540A

United States Patent [19]

Okamoto et al.

[11] Patent Number: 5,943,540

[45] Date of Patent: Aug. 24, 1999

[54] TRANSFER BELT DEVICE

[75] Inventors: Kenji Okamoto; Hideyuki Kurahashi; Masayasu Kato, all of Toyokawa; Masato Togami, Toyohashi, all of Japan

[73] Assignee: Minolta Co., Ltd., Osaka, Japan

[21] Appl. No.: 08/968,585

[22] Filed: Nov. 13, 1997

[30] Foreign Application Priority Data

Nov. 15, 1996 [JP] Japan ..... 8-305222

[51] Int. Cl.[6] ..... G03G 15/01

[52] U.S. Cl. ..... 399/302; 399/308

[58] Field of Search ..... 399/297, 302, 399/303, 308, 312, 313, 318

[56] References Cited

U.S. PATENT DOCUMENTS 5,040,028 8/1991 Kamimura et al. ..... 399/302

5,182,598 1/1993 Hara et al. ..... 399/303

5,493,371 2/1996 Kutsuwada et al. ..... 399/297 X 5,701,566 12/1997 Bisaiji et al. ..... 399/302

5,701,569 12/1997 Kanazawa et al. ..... 399/308

*Primary Examiner*—Sandra Brase

*Attorney, Agent, or Firm*—McDermott, Will & Emery

[57] ABSTRACT

A transfer belt device having a roller unit. The roller unit includes a drive roller, a transfer roller, and a continuous transfer belt that is suspended around the roller unit. The drive roller rotates at a peripheral speed and drives the transfer belt such that a toner image may be transferred to it from an image carrier. The image carrier moves at a speed by means of the transfer roller. The drive roller is composed of a hard core roller that is coated with an outer layer of elastic rubber having a thickness t≦1 mm, and is located downstream from the transfer roller in terms of the direction of movement of the transfer belt.

12 Claims, 6 Drawing Sheets

TRANSFER BELT DEVICE

FIELD OF THE INVENTION

The present invention pertains to a transfer belt device that transfers a toner image formed on an image carrier in an image forming apparatus such as a copying machine or printer, using an electrophotographic method.

BACKGROUND OF THE INVENTION

One representative example of an image-forming apparatus using the electrophotographic method that transfers a toner image formed on an image carrier to a transfer belt device is a full color image-forming apparatus that forms a multiple-colored image (e.g., a full-color image). In a full-color image-forming apparatus, toner images of each color that are sequentially formed on an image carrier are transferred sequentially, one on top of another, to a transfer belt such that they are superimposed onto the transfer belt, whereupon the overlapping toner images are finally transferred to a recording medium.

Specifically, in a full-color image-forming apparatus, toner images comprising such colors as cyan, yellow, magenta and black are sequentially formed on a photoreceptor drum through an electrophotographic process. As each color toner image is formed, it is transferred onto the transfer belt in a first transfer, and after toner images of each color are transferred onto the transfer belt and overlapping toner images are formed on the transfer belt, the overlapping toner images are then transferred onto the recording medium in a second transfer.

However, when this type of transfer belt device is used, the following problems arise.

If the transfer belt has the proper tension and is conveyed smoothly, and the conveyance speed is a constant speed essentially the same as that of the movement of the surface of the image carrier, the toner image on the image carrier is correctly transferred onto the transfer belt. However, in actuality the belt conveyance speed fluctuates and slackness may occur in the belt. If this is the case, and particularly if there is slackness in the section of the belt downstream from the transfer area where the transfer roller is in terms of the direction of belt movement, the toner image being transferred to the belt, or the toner images already transferred to the belt, become distorted or smudged.

The fluctuation in transfer belt conveyance speed or slackness in the transfer belt is caused mainly by its slipping off the belt drive roller or by fluctuations in the load on the belt. Slipping of the transfer belt occurs if there is insufficient friction between the surface of the drive roller and the transfer belt, even if the drive roller is driven at a prescribed speed. Fluctuation in the load on the belt may occur when a cleaning member is caused to come into contact with the belt at a location upstream from the transfer area in terms of the direction of belt movement, for example, in order to eliminate any toner that did not get transferred from the transfer belt to the recording medium during the second transfer and remained on the belt. Alternatively, such a fluctuation in load may occur when the second transfer roller is pressed onto the transfer belt via the recording medium in order to transfer onto the recording medium the toner images that were previously transferred onto the transfer belt.

Normally, in order to increase the speed of image formation, when the second transfer roller and cleaning member are pressed onto the belt in this way, the subsequent first transfer is also carried out at the same time. The result is a defective first transfer of the toner image arising due to a fluctuation in the load on the belt.

The slipping of the transfer belt referred to above is generally thought to be resolvable by forming the driver roller using an elastic material that increases the amount of friction between the transfer belt and the drive roller. However, if the drive roller were simply formed of an elastic material, when the load on the transfer belt changed, this fluctuation in load would be transmitted to the outer layer of the drive roller, which would become deformed, changing the roller's outer diameter and causing the belt conveyance speed to fluctuate.

Accordingly, the object of the present invention is to provide a transfer belt device that, simply through adjustment of the rotational speed of the belt drive roller, can eliminate fluctuations in belt conveyance speed and problematic slackness in the section of the transfer belt downstream from the area at which the toner image is transferred onto the transfer belt, in terms of the direction of belt movement, and can thereby transfer the toner image on the image carrier onto the transfer belt without problems such as distortion or smudging.

SUMMARY OF THE INVENTION

In order to resolve the problems described above, the object of the present invention is to provide a transfer device comprising a roller unit including a drive roller and a transfer roller and a continuous transfer belt suspended around the roller unit, wherein the transfer belt is driven to rotate by means of the drive roller and a toner image is transferred from an image carrier by means of the transfer roller, and wherein the drive roller comprises a hard core roller with a relatively thin outer layer of elastic rubber, and is located downstream from the transfer roller in terms of the direction of transfer belt movement.

The core roller is normally made of metal, conductive metal in particular, so that a transfer voltage may be applied to it, but if the hindrance of being impressed with transfer voltage is not present, it may be made of a non-metal substance or a compound of metal and a non-metal substance.

In the transfer belt device of the present invention, while it is acceptable if the peripheral speed of the drive roller is adjusted so as to be essentially the same as the speed of movement of the surface of the image carrier, in order to further ensure the elimination of slackness in the belt, it is desirable for the peripheral speed of the drive roller to be made slightly faster than the speed of movement of the surface of the image carrier.

The image carrier described above may be either a drum type or a belt type.

Because in the transfer belt device of the present invention, the belt drive roller comprises a hard core roller surrounded by an of elastic rubber and is located downstream from the transfer roller in terms of the direction of belt movement, slippage between the drive roller and the transfer belt may be minimized and the belt may be conveyed smoothly by adjusting the peripheral speed of the drive roller to be essentially equal to the speed of movement of the image carrier surface, or preferably by adjusting it to a speed slightly faster than the speed of movement of the image carrier surface. Slackness in the section of the belt downstream from the transfer roller may also be prevented.

In addition, because the rubber layer of the drive roller is relatively thin and is supported by a hard core roller, even where there is a fluctuation in the load on the belt, fluctuations in the diameter of the drive roller may be minimized, which in turn minimizes fluctuations in the belt conveyance speed. Consequently, toner images may be transferred from the image carrier onto the transfer belt without mishap.

DETAILED DESCRIPTION OF THE PREFERRED EMBODIMENTS

An embodiment of the present invention is explained below with reference to the drawings, wherein like reference numbers designate lie elements throughout the drawings.

Figure 1:
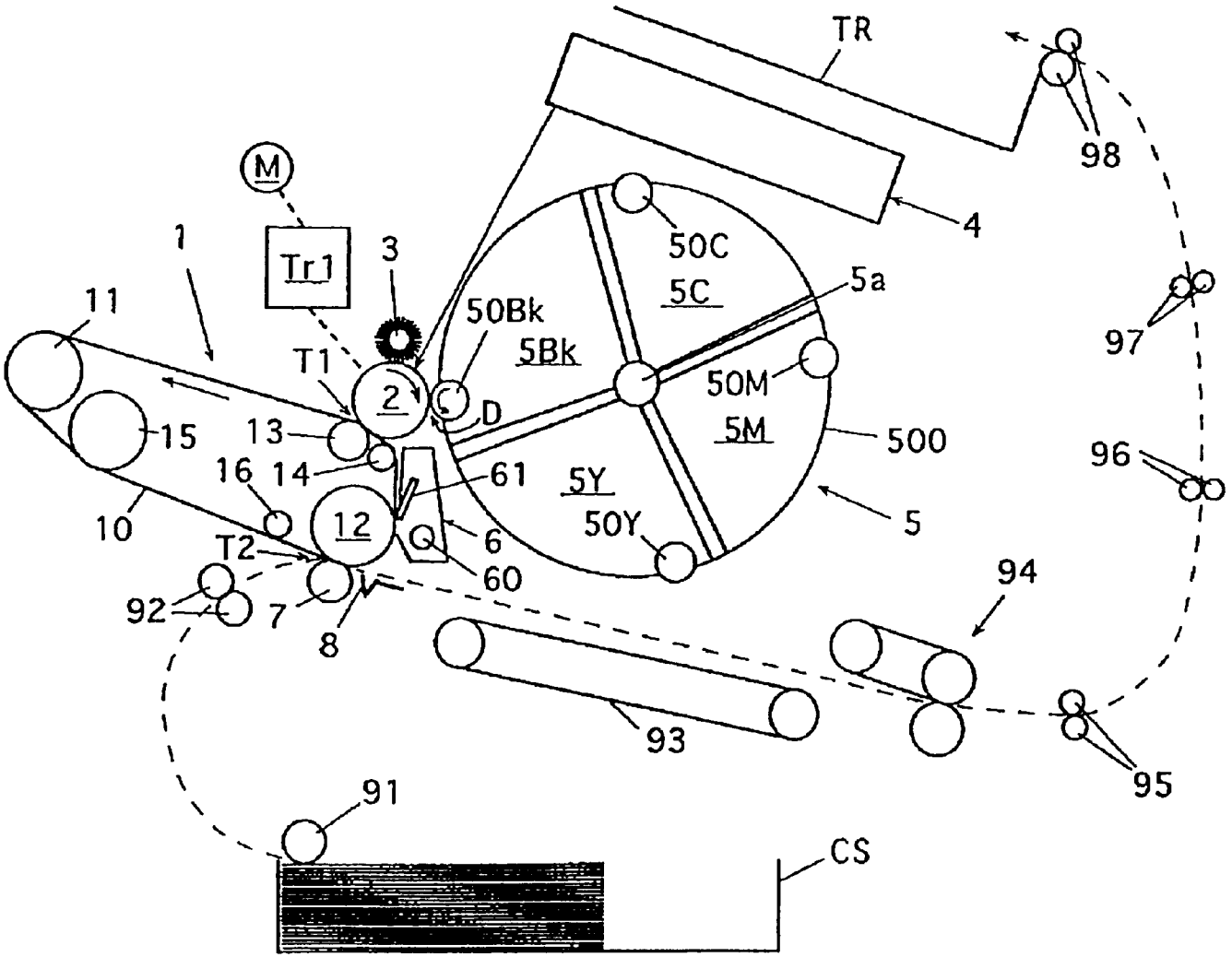
FIG. 1 is a drawing showing the outline construction of a color laser printer in which the cleaning device pertaining to the present invention is applied.

FIG. 1 is a drawing showing the outline of the construction of a full-color laser printer in which the transfer belt device pertaining to the present invention is applied.

The printer comprises photoreceptor drum 2 that is driven to rotate clockwise in the drawing by means of photoreceptor drive motor M via gear transmission mechanism Tr1, laser scanning optical system 4, full-color developing device 5, transfer belt device 1 containing continuous transfer belt 10, separating device 8, paper feeder cassette CS, and other components described below.

Charger brush 3 that uniformly charges the surface of photoreceptor drum 2 when it rotates, the developing device 5 and the transfer belt device 1 are each located adjacent to the outer surface of photoreceptor drum 2. A cleaner to eliminate the toner remaining on the photoreceptor drum after the first transfer is also located next to the photoreceptor drum, but is omitted from the drawings.

Laser scanning optical system 4 includes public domain components such as a laser diode, polygonal mirror, and f(θ) optical element, and image data for each color of cyan (C), magenta (M), yellow (Y) and black (Bk) is input to the control unit (not shown in the drawings) for the laser scanning optical system from a host device, such as a computer, to which the printer is connected. Laser beams corresponding to the image data for each color are irradiated onto photoreceptor drum 2 through the gap between charger brush 3 and developing device 5, so that an electrostatic latent image corresponding to each color is formed on the surface of photoreceptor drum 2.

Full-color developing device 5 comprises four single-color developer units 5C, 5M, 5Y and 5Bk that contain a developing agent including cyan (C), magenta (M), yellow (Y) and black (Bk) toner, respectively, which are attached to developing rack 500. Developing rack 500 can rotate clockwise in the drawing, using support shaft 5*a* as a fulcrum, by means of a dedicated motor omitted in the drawings. Single-color developer units 5C, 5M, 5Y and 5Bk are equipped with developing rollers 50C, 50M, 50Y and 50Bk, respectively. Each time that an electrostatic latent image corresponding to each color is formed on photoreceptor drum 2, developing device 5 is rotated so that the developer unit for that color is positioned at developing position D, and the electrostatic latent image corresponding to each color that is formed on photoreceptor drum 2 can be developed by means of the developer unit corresponding to that color. In this way, by using rotary-type full-color developing device 5, the entire printer may be made compact in this example. When each developing roller is positioned at the developing position, it is driven to rotate by means of the developing motor, not shown in the drawings, via a gear transmission mechanism.

Figure 2:
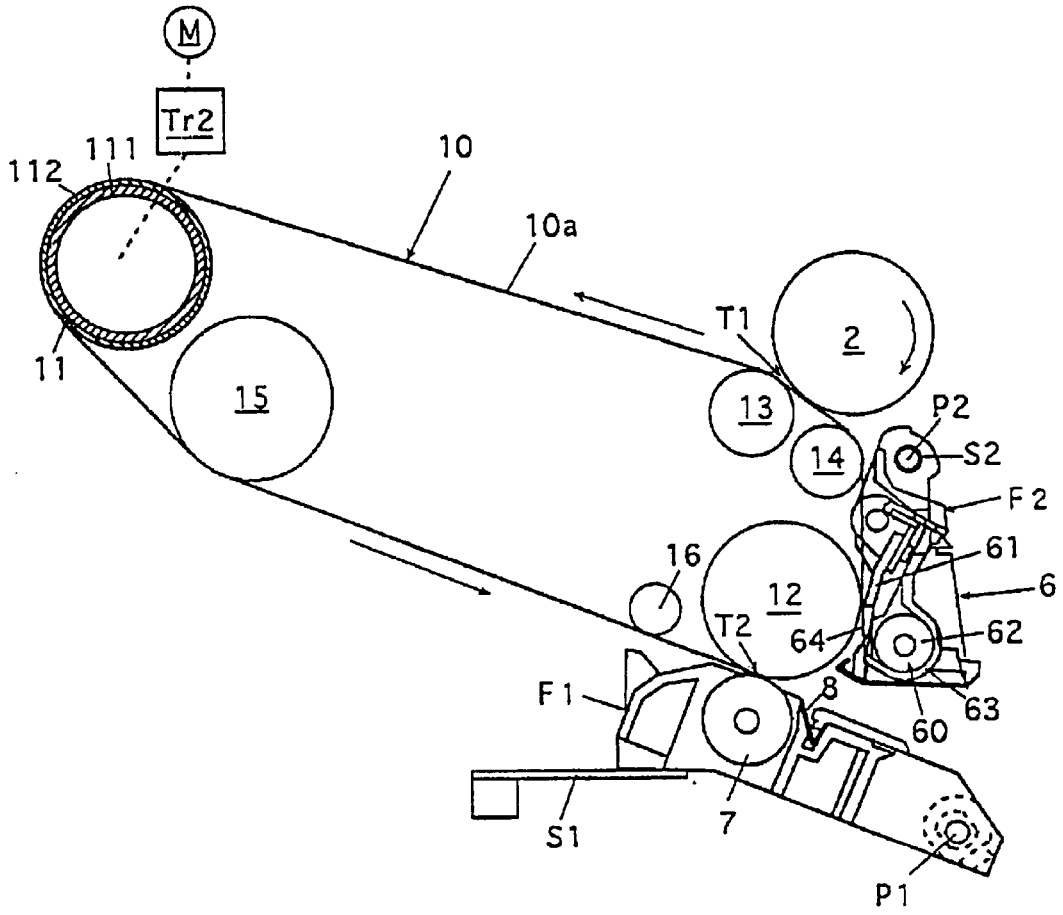
FIG. 2 is a drawing showing the details of the constructions of the transfer belt device and cleaning device in the printer shown in FIG. 1, when the cleaning blade and second transfer roller are in contact with the transfer belt.
Figure 3:
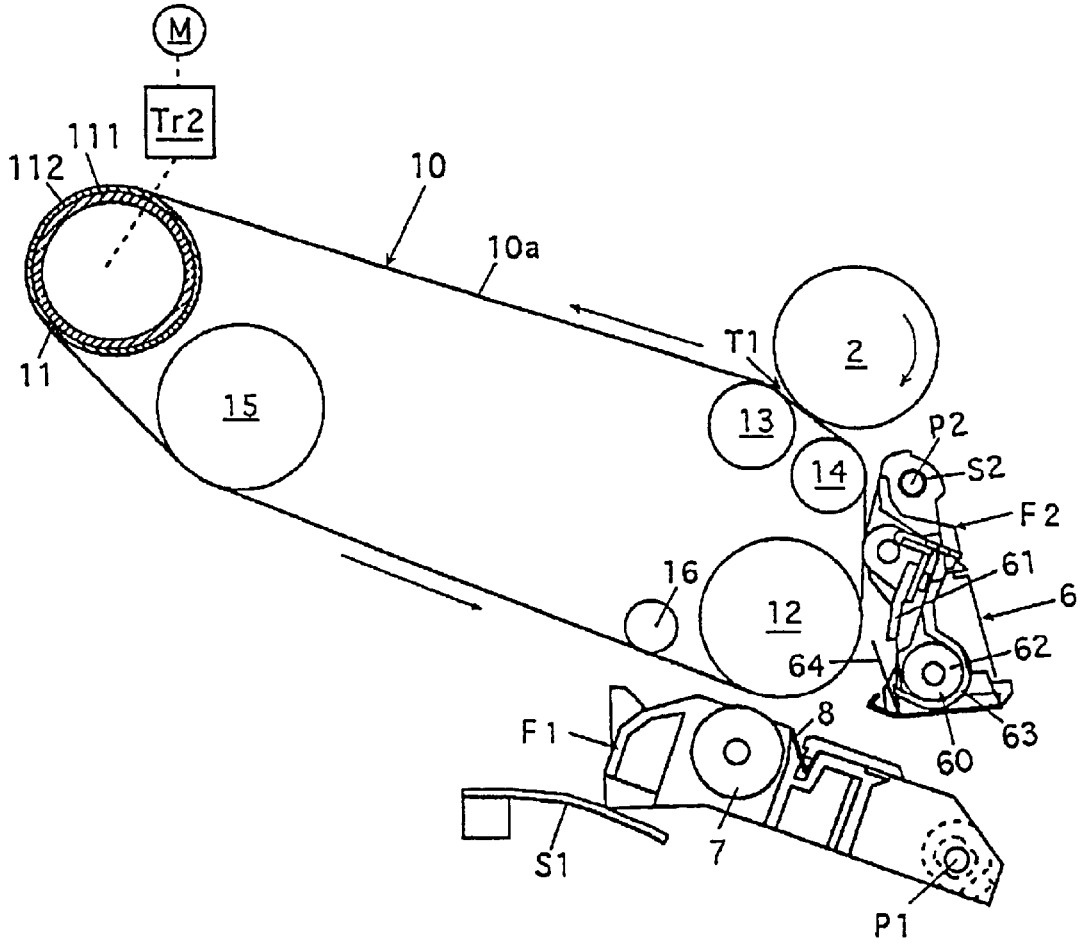
FIG. 3 is a drawing showing the details of the constructions of the transfer belt device and cleaning device in the printer shown in FIG. 1, when the cleaning blade and second transfer roller are separated from the transfer belt.

Transfer belt 10 of transfer belt device 1 is suspended around a roller unit comprising belt drive roller 11, tension roller 15, support roller 12, tension roller 14 and rotatable first transfer roller 13, as shown in FIGS. 2 and 3. Drive roller 11 can be driven to rotate counterclockwise in the drawing, via gear transmission mechanism Tr2, by means of the same motor M that drives photoreceptor drum 2, thereby allowing fixing belt 10 to be driven counterclockwise in the drawing as well.

Drive roller 11 is placed as the first roller downstream from first transfer roller 13 in terms of the direction of belt movement.

It is acceptable if the peripheral speed of drive roller 11 is essentially the same as the speed of movement of the surface of photoreceptor drum 2. However, in order to minimize slackness in section 10*a* of transfer belt 10 downstream from first transfer area T1 in terms of the direction of belt movement, and to prevent distortion or smudging of the toner image that can easily occur if such slackness is present, the peripheral speed of drive roller 11 is set at a surface speed slightly faster than that of the photoreceptor drum 2. However, increasing the relative peripheral speed of the drive roller 11 to an excessive degree would result in excessive belt slippage where the belt comes into contact with the image carrier, thereby causing a defective transfer of the toner image. Therefore, the surface speed of the drive roller 11 is preferably set to approximately 1.000–1.005 times the surface speed of the photoreceptor drum 2, and most preferably 1.001, or approximately 1.000–1.005 times the speed of the image carrier.

Belt drive roller 11 comprises hard core roller 111 preferably made of a hard conductive metal (i.e. aluminum), and having an outer diameter of approximately 30.03 mm. The outer diameter of the hard core roller 111 varies with particular construction and dimensions of the transfer belt device, the design of which is within the knowledge of one skilled in the art. The hard core roller 111 is surrounded by rubber layer 112, preferably having a thickness of up to approximately 1 mm, and most preferably 150 $\mu$m.

To ensure that noticeable transfer defects do not occur in the transfer of the toner image from the image carrier onto the transfer belt, the outer rubber layer surrounding the core roller is there to prevent the transfer belt from slipping off the drive roller and to create sufficient friction to drive the belt. However, because the rubber layer would become deformed and change the belt speed when the load on the transfer belt fluctuates if the rubber layer were too thick, the appropriate thickness is set at preferably up to approximately 1 mm, as described above, although this may vary depending on the type of rubber used.

Given the need for a thickness sufficient to create the necessary friction between the drive roller and the transfer belt to drive the transfer belt while preventing it from slipping off the drive roller, thereby preventing defective toner image transfers, and to obtain sufficient durability, the minimum thickness of the rubber layer is considered to be approximately 30 $\mu$m, although this also may vary depending on the type of rubber used.

In order to create sufficient friction to drive the belt while preventing the belt from slipping off the drive roller, as well as to reduce deformation in the rubber layer when the load on the transfer belt fluctuates, such that a noticeable transfer defect of the toner image may not occur when it is transferred from the image carrier to the transfer belt, the hardness of the rubber layer is preferably between 20° and 40° on the Asker-A hardness scale, and most preferably between 22° and 28°.

In the present embodiment, transfer belt 10 is made of ETFE (ethylene tetrafluoroethylene) in which carbon black having twice the weight of the ETFE is dispersed as a conductive filler, however, other potential compositions for transfer belt 10 would be known to one skilled in the art.

Transfer belt 10 is in contact with photoreceptor drum 2 due to the pressure exerted by first transfer roller 13, and this contact area constitutes first transfer area T1. A first transfer power supply omitted from the drawings is connected to first transfer roller 13, such that a first transfer voltage may be applied in order to carry out a first transfer of the toner image on the photoreceptor drum onto transfer belt 10. Roller 16 for grounding purposes is in contact with transfer belt 10 at a section slightly upstream from support roller 12.

Further, second transfer roller 7 may be made to come into contact with transfer belt 10 at a section supported by support roller 12. This contact area constitutes second transfer area T2. As shown in FIGS. 2 and 3, second transfer roller 7 is rotatably supported by frame F1 that can move with shaft P1 as its rotational shaft, and force is applied to it at all times in the direction of belt 10 by means of plate spring S1 that acts on frame F1. In addition, a second transfer power supply omitted from the drawings is connected to second transfer roller 7 such that a second transfer voltage may be applied to transfer roller 7 from the power supply. Through this transfer voltage, toner images formed on transfer belt 10 in a manner described below may be transferred onto the recording medium that passes between transfer belt 10 and second transfer roller 7 that is pressed onto the transfer belt.

Cleaning device 6 is located between second transfer area T2 and first transfer area T1 (or tension roller 14, to be more precise) in terms of the direction of movement of the surface of transfer belt 10. Cleaning device 6 has cleaning blade 61. It can scrape off the toner remaining on transfer belt 10 by causing blade 61 to come into contact with the section of transfer belt 10 that is supported by support roller 12. Cleaning device 6 contains frame F2 that can move with shaft P2 as its rotational shaft, and cleaning blade 61 is mounted on the frame. Force is applied at all times to cleaning blade 61 toward belt 10 by means of spring S2 that is mounted on shaft P2 and acts on frame F2.

Frame F2 also has toner ejection area 60 immediately beneath cleaning blade 61. Toner ejection area 60 is equipped with toner conveyance screw 62 for ejecting toner, which extends in the direction perpendicular to the direction of movement of belt 10, toner tray 63 that is located under the screw, and pliable sealing plate 64 that stands erect in front of toner tray 63 and maintains its position via elastic resiliency.

Toner conveyance screw 62 moves in linkage with cleaning blade 61. When cleaning blade 61 is in contact with transfer belt 10, toner conveyance screw 62 becomes located near the belt, and pliable sealing plate 64 comes into contact with belt 10 to lead the toner falling from blade 61 toward screw 62 and toner tray 63 (see FIG. 2). When cleaning blade 61 separates from belt 10, screw 62 also retracts from belt 10 (see FIG. 3).

Figure 4:
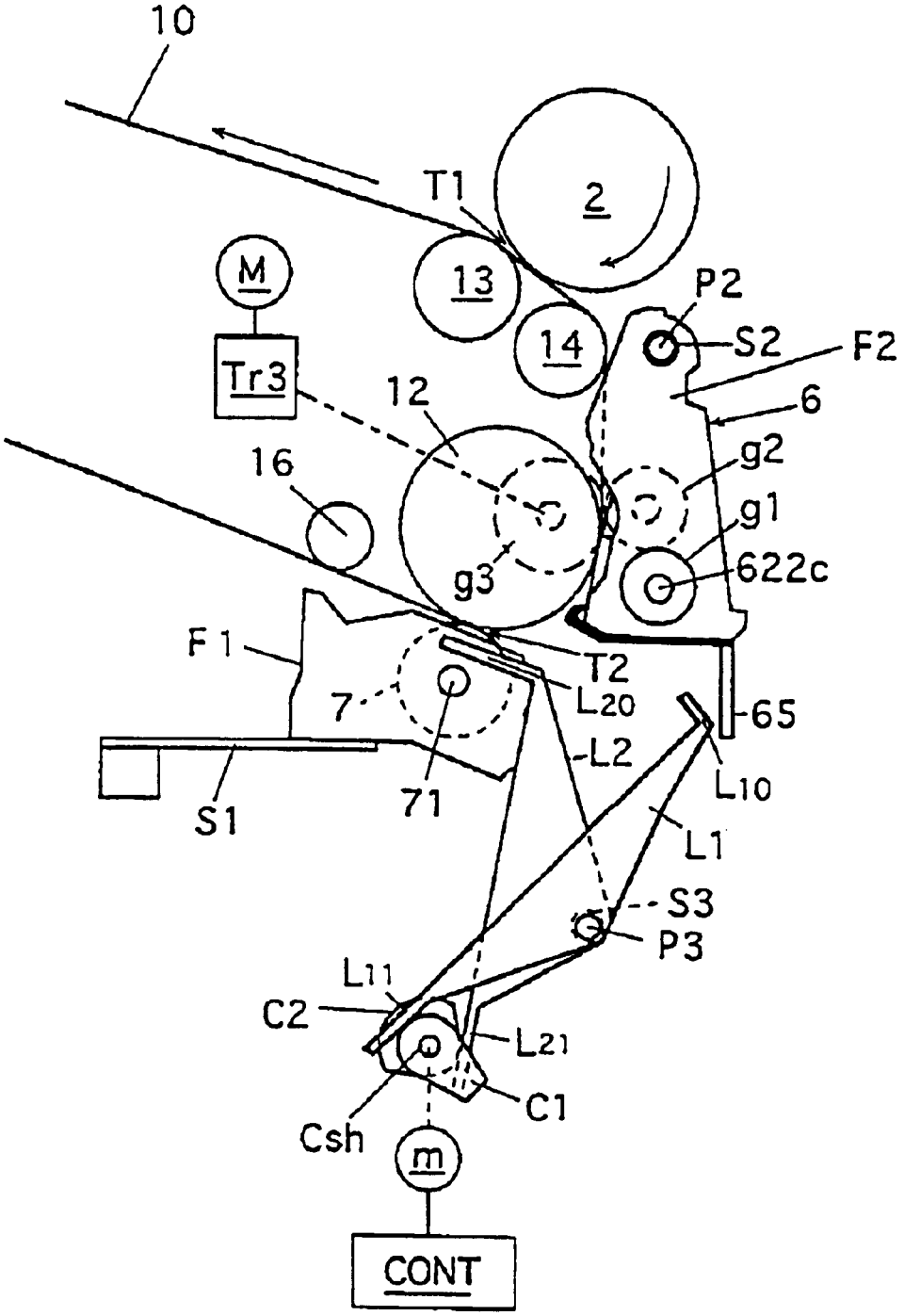
FIG. 4 is a drawing showing the cleaning device and second transfer roller shown in FIG. 1, in which the cam mechanism is allowing the cleaning blade and second transfer roller to be in contact with the transfer belt.
Figure 5:
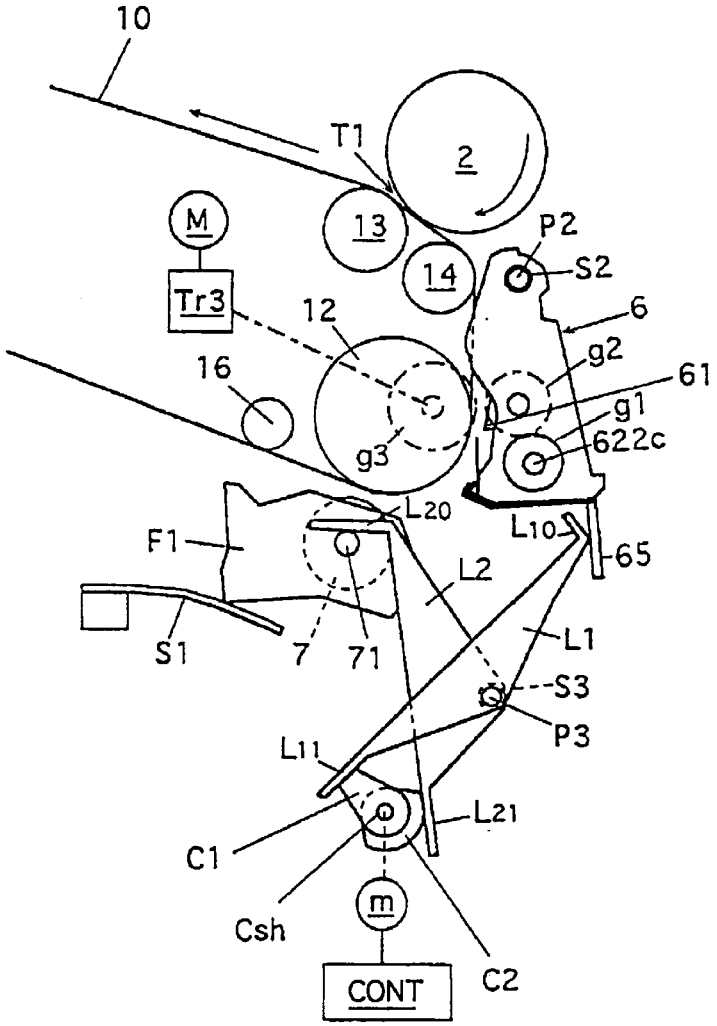
FIG. 5 is a drawing showing the cleaning device and second transfer roller shown in FIG. 1, in which the cam mechanism is separating the cleaning blade and second transfer roller from the transfer belt.
Figure 6:
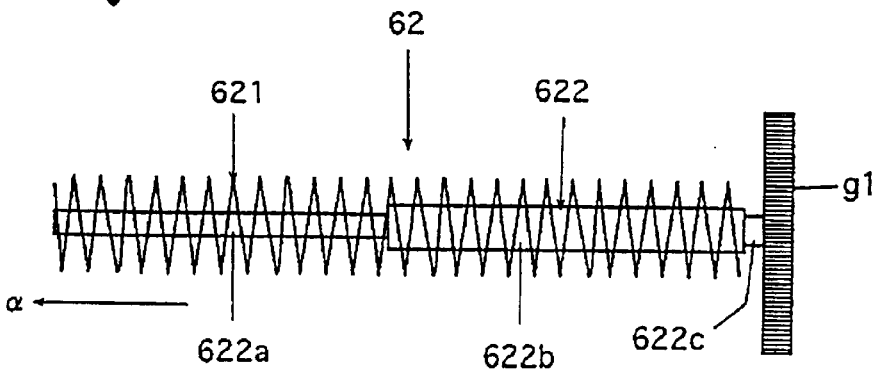
FIG. 6 is a drawing showing the toner conveyance screw that is located inside the cleaning device and is used to eject toner.

The outer diameter of screw blade 621 of toner conveyance screw 61 stays essentially constant throughout its entirety along the screw shaft, as shown in FIG. 6, while screw shaft 622 comprises upstream half 622*a* having a larger diameter and downstream half 622*b* having a smaller diameter in terms of toner ejection direction $\alpha$. Upstream end 622*c* of screw shaft 622 is supported by frame F2 such that screw shaft 622 can rotate, and gear g1 is located at the end, as shown in FIGS. 4 and 5. This gear g1 is engaged with another gear g2 that is rotatably located on frame F2.

When cleaning blade 61 comes into contact with belt 10, as shown in FIG. 4, gear g2 becomes engaged with gear g3 that is located at a fixed position and is driven by the photoreceptor drum drive motor M via gear transmission mechanism Tr3, and is rotated. As a result, screw 62 is turned in the direction to eject toner. When cleaning blade 61 separates from belt 10, gear g2 separates from gear g3, as shown in FIG. 5, and screw 62 stops. In other words, screw 62 does not move except for when cleaning blade 61 cleans belt 10.

Cleaning blade 61 and second transfer roller 7 are made to come in contact with transfer belt 10 when toner images of prescribed colors have been transferred from photoreceptor drum 2 to transfer belt 10 at first transfer area T1 and before the overlapping toner images thus formed on the belt reach second transfer area T2. When the second transfer is completed and the rear end of the belt section on which the overlapping toner images were present has passed cleaning blade 61, cleaning blade 61 and second transfer roller 7 are both separated from belt 10 and toner conveyance screw 61 stops inside cleaning device 6.

Cleaning blade 61 and second transfer roller 7 are made to come into contact with and separate from belt 10 by means of the cam mechanism shown in FIGS. 4 and 5.

In other words, fixed shaft P3 is located near transfer belt 10, the shaft supporting a pair of levers L1 and L2 such that they can move. Upper end L10 of lever L1 faces arm 65 that is mounted on cleaning device frame F2 while upper end L20 of lever L2 faces shaft 71 that protrudes outward from frame F1 of second transfer roller 7. On the other hand, lower end L11 of lever L1 faces cam C1 while lower end L21 of lever L2 faces cam C2. Levers L1 and L2 are given force by spring S3 placed on shaft P3 such that their ends seek to move toward each other.

Cams C1 and C2 are both supported on cam shaft Csh and may be rotated in a linked fashion by means of cam motor M, as if they were a single unit. The driving of cam motor m is controlled based on instructions from control unit CONT that controls the printing operation.

During the second transfer of the overlapping toner images on belt 10 to the recording medium, when cleaning blade 61 and second transfer roller 7 are both in contact with belt 10, cams C1 and C2 are positioned as shown in FIG. 4, wherein cam C1 is in contact with lower end L11 of lever L1 using the cam surface having the shorter distance from cam shaft Csh, and cam C2 is in contact with lower end L21 of lever L2 using the cam surface also having the shorter distance from cam shaft Csh. Therefore, upper ends L10 and L20 of levers L1 and L2, respectively are positioned so as to be close to each other and are separated from arm 65 of cleaning device 6 and shaft 71 of second transfer roller 7, respectively. Consequently, cleaning blade 61 and transfer roller 7 come into contact with belt 10 by means of spring S2 and plate spring S1, respectively.

When the second transfer of the overlapping toner images is completed and the rear end of the belt section on which the overlapping toner images were present has passed cleaning blade 61, cams C1 and C2 are immediately rotated 180° by means of motor m, as shown in FIG. 5. This causes cam C1 to come into contact with lower end L11 of lever L1 using the cam surface having a longer distance from cam shaft Csh, while it also causes cam C2 to come into contact with lower end L21 of lever L2 using the cam surface also having a larger distance from cam shaft Csh. In this way, upper end L10 of lever L1 pushes arm 65 of cleaning device 6 against the force of spring S2 and separates cleaning blade 61 from belt 10. At the same time, upper end L20 of lever L2 engages with shaft 71 of second transfer roller 7 and pushes it downward against the force of plate spring S1 and separates second transfer roller 7 from belt 10. When cams C1 and C2 are rotated approximately 90° from the positions shown in FIG. 4, second transfer roller 7 may be kept separate from belt 10 while cleaning blade 61 is in contact with belt 10. This situation may be applied when a test toner image is formed on belt 10, for example.

Feeder cassette CS referred to above houses recording media (transfer paper in this embodiment) to which the toner images are transferred so that the recording media may be fed out individually by means of feeding roller 91. In the recording medium conveyance path indicated via a dotted line in the drawing is located a pair of timing rollers 92 to feed the recording medium to the second transfer area in synchronization with the toner images on transfer belt 10.

Separating device 8 to separate the recording medium from transfer belt 10 is located downstream from the second transfer area in the recording medium conveyance path. Separating device 8 comprises a discharging needle.

Further downstream from separating device 8 are located conveyance belt 93 to carry the separated recording medium to belt fusing device 94, belt fusing device 94 to heat and fuse the toner images onto the recording medium, conveyance roller pairs 95, 96 and 97, and ejection roller 98. The recording medium ejected by ejection roller 98 is housed in ejection tray TR.

The recording medium conveyance system and belt fusing device are driven by means of photoreceptor drive motor M via a transmission mechanism not shown in the drawing.

The full-color printing operation of this printer is explained below (see FIG. 1).

Figure 7:
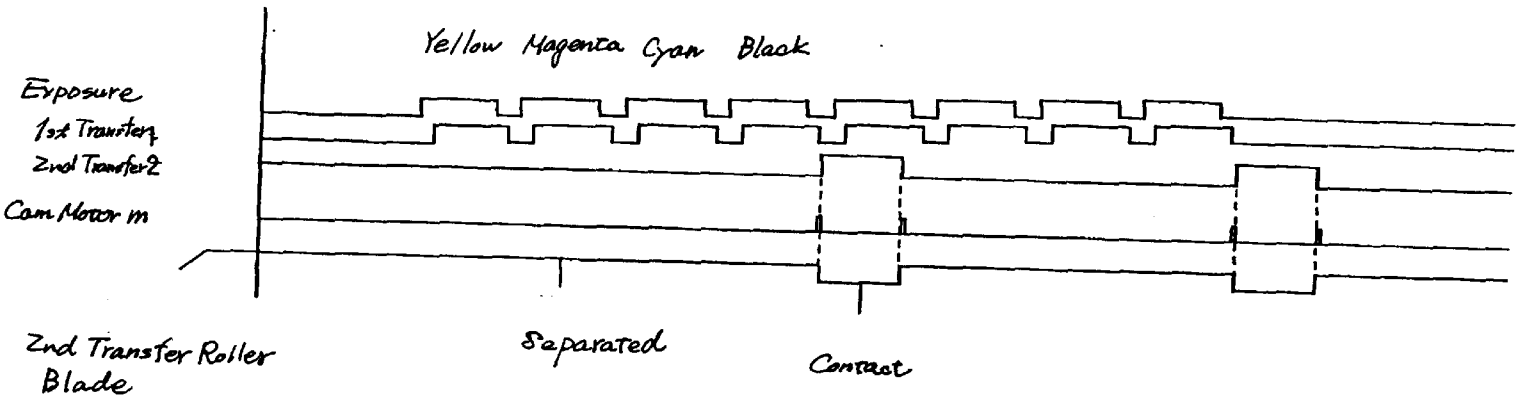
FIG. 7 is a timing chart showing the timing sequences, etc for the cleaning blade and second transfer roller to come into contact with or separate from the transfer belt.

FIG. 7 shows the timing sequences regarding image exposure for each color onto photoreceptor drum 2 based on the instructions from control unit CONT, the first and second transfers, the turning ON and OFF of cam motor m, and the coming into contact with and separating of blade 61 and second transfer roller 7 from belt 10.

Prior to the commencement of the printing operation (image formation for the first color), second transfer roller 7 and blade 61 of cleaning device 6 are separated from transfer belt 10. Black developer unit 5Bk faces developing position D. When the printing operation begins, photoreceptor drum 2 is driven to rotate clockwise in the drawing and transfer belt 10 is driven to rotate counterclockwise in the drawing. Photoreceptor drum 2 is charged up to a prescribed level of potential by charger brush 3. As the printing operation begins, the developer unit switching operation also starts and yellow developer unit 5Y is placed at developing position D.

Exposure of the yellow image is then carried out by laser scanning optical system 4 and an electrostatic latent image of the yellow image is formed on photoreceptor drum 2. This electrostatic latent image is immediately developed by developer unit 5Y and the toner image is transferred onto transfer belt 10 at the first transfer area. Immediately after the completion of the first transfer, magenta developer unit 5M is placed at developing position D and exposure, development and first transfer of the magenta image are carried out. Switching to cyan developer unit 5C and exposure, development and first transfer of the cyan image, and subsequently switching to black developer unit 5Bk and exposure, development and first transfer of the black image are then carried out in the same manner.

A new toner image is superimposed onto transfer belt 10 each time a first transfer takes place.

When the last first transfer is completed, second transfer roller 7 and blade 61 are pressed so as to come into contact with transfer belt 10. At this time, a recording medium is fed to second transfer area T2 and the overlapping toner images formed on transfer belt 10 are transferred onto the recording medium by second transfer roller 7 to which a transfer voltage is applied. The toner that was not transferred to the recording medium at second transfer area T2 and remains on transfer belt 10 is scraped off by blade 61 to make belt 10 ready for the next image formation. When this second transfer is completed and the rear end of the belt section on which the overlapping toner images were present has passed cleaning blade 61, second transfer roller 7 and cleaning blade 61 are both separated from transfer belt 10 and toner conveyance screw 62 of cleaning device 6 stops.

The recording medium that has passed second transfer area T2 is carried to fusing device 94 where the toner images are heated and fused, after which the recording medium is ejected onto ejection tray TR.

Using transfer belt device 1 described above, since belt drive roller 11 comprises hard core roller 111 which is covered with a silicone rubber layer and is located downstream from first transfer roller 13 in terms of the direction of belt movement, and the peripheral speed of drive roller 11 is set to be slightly higher than the speed of the movement of the surface of photoreceptor drum 2 (peripheral speed), the slippage between drive roller 11 and belt 10 is minimized so that transfer belt 10 may be smoothly moved, and the slackness of belt section 10*a* downstream from transfer roller 13 may be eliminated. In addition, because rubber layer 112 of drive roller 11 is thin and is supported by hard core roller 111, when there is a fluctuation in the load on belt 10, as when second transfer roller 7 and cleaning blade 61 come into contact with transfer belt 10 or when they separate from belt 10, fluctuations in the outer diameter of drive roller 11 is eliminated, which in turn reduces fluctuations in the speed of the transfer belt conveyance. Consequently, a good quality first transfer of a toner image from photoreceptor drum 2 to transfer belt 10 is carried out.

Using cleaning device 6 described above, since toner conveyance screw 62 does not move except during the cleaning of transfer belt 10, the scattering of toner particles due to the screw rotation is reduced to that extent, which in turn reduces the adherence of toner particles to intermediate transfer belt 10. Consequently, a high-quality subsequent toner image (first transfer toner image) may be formed on transfer belt 10.

The removal and dropping of residual toner from transfer belt 10 by cleaning blade 61 takes place from the moment at which the top end of the section of belt 10 on which the overlapping toner images were present passes cleaning blade 61 until the moment at which the rear end of the section passes cleaning blade 61. Even if the residual toner continuously falls onto toner conveyance screw 62 during this time, as shown in FIG. 6, because the outer diameter of screw blade 621 is essentially constant throughout its entirety and the diameter of screw shaft 622 gradually decreases from the upstream side to the downstream side in terms of toner ejection direction α, the downstream screw area carries more toner and therefore the toner that has fallen onto screw 62 is smoothly ejected in general. Consequently, the occurrence of scattering of toner particles is reduced to that extent, which in turn reduces the adherence of toner particles to belt 10 and therefore a high quality subsequent toner image (first transfer toner image) may be formed on the transfer belt. Although screw shaft 622 is supported using upstream side end 622*c* in terms of toner conveyance direction α such that it can rotate, and receives its driving force through the end 622*c*, since screw shaft 622 is formed to have a larger diameter on the upstream side than on the downstream side in terms of toner ejection direction α, there is no problem in regard to its strength.

Since screw blade 621 has an essentially constant outer diameter throughout its entirety and screw shaft 622's diameter gradually decreases from the upstream side to the downstream side in terms of toner ejection direction α, when toner conveyance screw 62 is stationary except during cleaning, with some toner still remaining on screw 62 (on the downstream side area in terms of toner ejection direction α in particular), and if cleaning blade 61 removes residual toner from transfer belt 10 in order to drop the residual toner onto screw 62 in the next cleaning session, the scattering of toner particles is reduced and the toner is smoothly ejected.

While the explanation provided above pertains to an example in which the present invention is applied in a full-color printer, the present invention may be applied in a color copier or so called black-and-white printer or copier as well.

As explained above, using the present invention, simply by adjusting the rotational speed of the belt drive roller, fluctuations in the speed of the transfer belt and problematic slack in the section of the transfer belt downstream from the transfer area at which the toner image is transferred to the transfer belt in terms of the direction of belt movement may be eliminated, as a result of which a transfer belt device that can transfer the toner image on the image carrier onto the transfer belt without such inconveniences as deformation or smudging of the toner image may be provided.

What is claimed is:

1. A transfer belt device, comprising:

a roller unit including a drive roller and a transfer roller; and a continuous transfer belt suspended around the roller unit, the transfer belt being driven by the drive roller such that a toner image may be transferred, by means of the transfer roller, to the continuous transfer belt from an image carrier moving at a surface speed; and wherein the drive roller rotates at a peripheral speed that is greater than the surface speed of the image carrier; and wherein the drive roller comprises a hard core roller that is coated with an outer layer of elastic rubber having a thickness $t \leqq 1$ mm, and is located downstream from the transfer roller in terms of the direction of movement of the transfer belt.

2. The transfer belt device claimed in claim 1, wherein the hardness of the rubber layer is between approximately 20° and approximately 40° on an Asker-A hardness scale.

3. The transfer belt device claimed in claim 2, wherein the peripheral speed of the drive roller is approximately 1.001–1.005 times greater than the surface speed of the image carrier.

4. The transfer belt device claimed in claim 1, wherein the peripheral speed of the drive roller is approximately 1.001–1.005 times greater than the surface speed of the image carrier.

5. An image forming apparatus, comprising:

a photoreceptor drum that rotates at a surface speed; and a transfer belt device, said transfer belt device, comprising:

a roller unit including a drive roller and a transfer roller; and a continuous transfer belt suspended around the roller unit, the transfer belt being driven by the drive roller such that a toner image may be transferred, by means of the transfer roller, to the continuous transfer belt from the photoreceptor drum; and wherein the drive roller rotates at a peripheral speed that is greater than the surface speed of the photoreceptor drum; and wherein the drive roller comprises a hard core roller that is coated with an outer layer of elastic rubber having a thickness $t \leqq 1$ mm, and is located downstream from the transfer roller in terms of the direction of movement of the transfer belt.

6. The transfer belt device claimed in claim 5, wherein the hardness of the rubber layer is between approximately 20° and approximately 40° on an Asker-A hardness scale.

7. The transfer belt device claimed in claim 6, wherein the peripheral speed of the drive roller is approximately 1.001–1.005 times greater than the surface speed of the photoreceptor drum.

8. The transfer belt device claimed in claim 6, wherein the peripheral speed of the drive roller is approximately 1.001 times greater than the surface speed of the photoreceptor drum.

9. The transfer belt device claimed in claim 5, wherein the peripheral speed of the drive roller is approximately 1.001–1.005 times greater than the surface speed of the photoreceptor drum.

10. The transfer belt device claimed in claim 5, wherein the peripheral speed of the drive roller is approximately 1.001 times greater than the surface speed of the photoreceptor drum.

11. An image forming apparatus comprising:

an image carrier that rotates at a surface speed;

an image former for forming a toner image on a surface of the image carrier;

a transfer belt that rotates in a rotation path;

a first transfer roller for transferring the toner image from the image carrier to the transfer belt and suspending the belt at a first location;

a second transfer roller for transferring the toner image from the transfer belt to a recording medium, such that, while the first transfer roller transfers toner image from the image carrier to the transfer belt, the second transfer roller transfers the toner image from the transfer belt to the recording medium; and a drive roller for driving the transfer belt and suspending the transfer belt at a second location, the drive roller being located between the first transfer roller and the second transfer roller in the rotation path of the transfer belt, and the drive roller having a coated elastic rubber layer of a thickness of approximately 1 millimeter or less.

12. The image forming apparatus of claim 11, wherein a peripheral speed of the drive roller is approximately 1.001–1.005 times greater than the surface speed of the image carrier.

* * * * *